US009810135B2

(12) United States Patent
Ishikawa et al.

(10) Patent No.: US 9,810,135 B2
(45) Date of Patent: Nov. 7, 2017

(54) COOLING FAN DEVICE FOR VEHICLE

(71) Applicants: Eiji Ishikawa, Toyota-shi, Aichi-ken (JP); Tsuyoshi Seike, Toyota-shi, Aichi-ken (JP); KABUSHIKI KAISHA TOYOTA JIDOSHOKKI, Kariya-shi, Aichi-ken (JP); DENSO CORPORATION, Kariya-shi, Aichi-ken (JP)

(72) Inventors: Eiji Ishikawa, Okazaki (JP); Tsuyoshi Seike, Okazaki (JP); Yusuke Hoshikawa, Kariya (JP); Sunao Hirota, Kariya (JP)

(73) Assignees: KABUSHIKI KAISHA TOYOTA JIDOSHOKKI, Aichi-ken (JP); TOYOTA JIDOSHA KABUSHIKI KAISHA, Aichi-ken (JP); DENSO CORPORATION, Aichi-ken (JP)

( * ) Notice: Subject to any disclaimer, the term of this patent is extended or adjusted under 35 U.S.C. 154(b) by 264 days.

(21) Appl. No.: 14/646,052

(22) PCT Filed: Nov. 19, 2013

(86) PCT No.: PCT/JP2013/081196
§ 371 (c)(1),
(2) Date: May 20, 2015

(87) PCT Pub. No.: WO2014/080914
PCT Pub. Date: May 30, 2014

(65) Prior Publication Data

US 2015/0300238 A1 Oct. 22, 2015

(30) Foreign Application Priority Data

Nov. 22, 2012 (JP) ..... 2012-256262

(51) Int. Cl.
*F01P 5/06* (2006.01)
*F01P 11/10* (2006.01)
(Continued)

(52) U.S. Cl.
CPC *F01P 5/06* (2013.01); *F01P 5/02* (2013.01); *F01P 11/10* (2013.01); *F01P 11/12* (2013.01);
(Continued)

(58) Field of Classification Search
CPC F01P 5/02; F01P 5/06; F01P 2005/025; F01P 11/10; F01P 11/12; F04D 29/663;
(Continued)

(56) References Cited

U.S. PATENT DOCUMENTS 4,194,556 A 3/1980 Watanabe et al.
5,277,547 A * 1/1994 Washizu ..... F04D 25/166 165/122
(Continued)

FOREIGN PATENT DOCUMENTS

DE 4324071 A1 1/1995
DE 102008041236 A1 2/2010
(Continued)

OTHER PUBLICATIONS

English translation of DE 10019237.*
(Continued)

*Primary Examiner* — Woody Lee, Jr.
*Assistant Examiner* — Topaz L Elliott
(74) *Attorney, Agent, or Firm* — Sughrue Mion, PLLC

(57) ABSTRACT

This cooling fan device for a vehicle comprises: a fan shroud which is shaped as a box accommodating a radiator and/or a condenser, and which has an opening in the front side in the travel direction of the vehicle and a fan coupling surface in the rear side in the travel direction; at least two cooling fans disposed in the fan coupling surface, the cooling fans
(Continued)

having center axes vertically separated from each other by a predetermined distance; and a shield rib extending downward from the top of the fan coupling surface, protruding toward the radiator and/or the condenser, and having a top end and a bottom end, the shield rib being provided to the fan coupling surface between the adjacent cooling fans. The top end and/or the bottom end of the shield rib have a cutout section allowing air to pass between the adjacent cooling fans.

5 Claims, 3 Drawing Sheets

(51) Int. Cl.

| | |
|---|---|
| ***F04D 29/66*** | (2006.01) |
| ***F01P 11/12*** | (2006.01) |
| ***F04D 25/16*** | (2006.01) |
| ***F04D 19/00*** | (2006.01) |
| ***F01P 5/02*** | (2006.01) |

(52) U.S. Cl.
CPC ..... *F04D 19/002* (2013.01); *F04D 25/166* (2013.01); *F04D 29/667* (2013.01); *F01P 2005/025* (2013.01)

(58) Field of Classification Search
CPC .... F04D 29/667; F04D 29/325; F04D 29/526; F04D 29/424; F04D 29/4253
USPC ..... 416/169 A
See application file for complete search history.

(56) References Cited

U.S. PATENT DOCUMENTS

| | | | | |
|---|---|---|---|---|
| 5,947,189 | A | 9/1999 | Takeuchi et al. | |
| 6,401,801 | B1 | 6/2002 | Dicke | |
| 6,752,587 | B2 * | 6/2004 | Lin | F04D 25/166 415/220 |
| 6,817,831 | B2 * | 11/2004 | Stevens | F04D 29/582 415/61 |
| 7,987,938 | B2 * | 8/2011 | Morita | B60K 11/04 180/229 |
| 8,291,721 | B2 * | 10/2012 | Stauter | B60H 1/3229 62/239 |
| 2004/0020449 | A1 | 2/2004 | Stevens et al. | |

FOREIGN PATENT DOCUMENTS

| | | | | |
|---|---|---|---|---|
| JP | 2555413 | Y2 | 11/1997 | |
| JP | 10-252470 | A | 9/1998 | |
| JP | DE 10019237 | A1 * | 11/2000 | F01P 11/12 |
| JP | 2004-299444 | A | 10/2004 | |
| JP | 2005-163720 | A | 6/2005 | |
| JP | 2005-520969 | A | 7/2005 | |
| JP | EP 1624196 | A2 * | 2/2006 | F04D 29/541 |
| JP | 2012031755 | A | 2/2012 | |
| WO | 03/078848 | A1 | 9/2003 | |

OTHER PUBLICATIONS

English translation of "Communication dated Feb. 9, 2016, from the Japanese Patent Office in counterpart application No. 2012-256262".*

Communication dated Nov. 19, 2015, issued by the European Patent Office in corresponding European Application No. 13857066.8.

International Preliminary Report on Patentability and Written Opinion dated May 26, 2015 from the International Searching Authority in counterpart application No. PCT/JP2013/081196.

* cited by examiner

COOLING FAN DEVICE FOR VEHICLE

CROSS REFERENCE TO RELATED APPLICATIONS

This application is a National Stage of International Application No. PCT/JP2013/081196 filed Nov. 19, 2013, claiming priority based on Japanese Patent Application No. 2012-256262 filed Nov. 22, 2012, the contents of all of which are incorporated herein by reference in their entirety.

TECHNICAL FIELD

The technology of the present disclosure relates to a vehicle cooling fan device that includes cooling fans and a box-shaped fan shroud, which guides a flow of air to at least one of a radiator of a vehicle engine and a condenser of an air-conditioning device.

BACKGROUND ART

In general, a radiator cools the coolant that cools the engine of a vehicle, and a condenser cools the refrigerant used by an air conditioner of the vehicle. The radiator and the condenser are usually laid out so that they may be cooled by the flow of air drawn into the vehicle from the front when the vehicle is traveling.

However, the flow of air generated when the vehicle travels may become insufficient during traffic congestion. Thus, for example, a cooling fan is typically provided behind a radiator and a condenser. The cooling fan is able to generate a flow of air in the same direction as the flow of air generated when the vehicle travels. The radiator, the condenser, the cooling fan, and other components are accommodated in a box-shaped fan shroud to effectively use the flow of air of the cooling fan.

In recent years, various vehicle cooling fan devices have been proposed that include a fan shroud and a cooling fan.

For example, patent document 1 proposes a vehicle heat exchanger that includes two cooling fans and one fan controller. The fan controller generates a relatively large amount of heat and thus needs to be cooled properly. In patent document 1, the fan controller is placed on a fan shroud at a position separated from the central portion of the fan shroud to allow the fan controller to be cooled by some of the air flowing from one of the cooling fans. Further, in patent document 1, a duct extends from the fan controller toward the other cooling fan so that some of the air flowing from the other cooling fan is drawn to the fan controller. Thus, the fan controller is properly cooled even when one of the cooling fans stops. A partition wall, which partitions operation areas of the cooling fans, extends between the adjacent cooling fans toward the radiator. As described in patent document 1, a communication section may be provided in the upper portion of the partition wall, which is near the fan controller, to increase the air flowing to the fan controller.

Patent document 2 describes two cooling fans that have a larger diameter to increase the amount of the flowing air. The two cooling fans partially overlap each other in a fan shroud. The high velocity of the flowing air where the cooling fans overlap each other may produce annoying noise when the cooling fans are driven. Thus, the fan blades have a special shape to reduce noise. In patent document 2, since the cooling fans overlap each other, a partition wall is not provided to partition the operation areas of the cooling fans.

PRIOR ART DOCUMENTS

Patent Documents

Patent Document 1: Japanese Laid-Open Patent Publication No. 2005-163720

Patent Document 2: Japanese National Phase Laid-Open Patent Publication No. 2005-520969

SUMMARY OF THE INVENTION

Problems that the Invention is to Solve

Patent document 1 is silent with regard to the noise produced when the cooling fans are driven and the reduction of such noise.

In patent document 2, to reduce noise when the cooling fans are driven, the fan blades have a special shape, the ratio of the diameter of one cooling fan to the diameter of the other cooling fan is limited, and the overlapping range of the cooling fans is limited. This complicates the structure and greatly limits the freedom of design. Further, the cause of noise may be the shape of the radiator or the like through which air flows and not the cooling fans. In such a case, noise cannot be properly reduced.

When the flow of air generated by a cooling fan does not have a uniform velocity and the velocity is high in certain areas, noise is easily produced when the cooling fan is driven. In addition, when the rotation speed of the cooling fan is relatively high, noise is easily produced when the cooling fan is driven. The following three methods (1) to (3) may be considered to reduce noise.

(1) Reduce the rotation speed of the cooling fan.

(2) Perform variable control of the rotation speed of the cooling fan using a fan controller to avoid the rotation speed at which there is a tendency of noise being produced.

(3) Place an obstacle (e.g., shielding plate) in an area where the flow of air generated by the cooling fan has a high velocity to eliminate the high-velocity area to increase the uniformity of the velocity.

However, methods (1) to (3) listed above may reduce the cooling performance and are thus undesirable.

Alternatively, a uniform velocity may be obtained by increasing the number of blades of the cooling fan or by enlarging the space around the cooling fan. However, when the cause of noise is not the cooling fan and is another factor such as the shape of the radiator through which air flows, an increase in the number of blades would not be able to properly reduce noise. Further, enlargement of the space around the cooling fan is extremely difficult due to the limited space in a vehicle.

It is an object of the present disclosure to provide, in the limited space of a vehicle, a vehicle cooling fan device capable of reducing noise when a cooling fan is driven with a structure that is simpler and without lowering the cooling performance.

Means for Solving the Problems

To achieve the above object, a vehicle cooling fan device includes a fan shroud, at least two cooling fans, and a shield rib. The fan shroud is box-shaped and accommodates at least one of a radiator and a condenser. The fan shroud includes an opening located at a front side in a traveling direction of a vehicle and a fan coupling surface located at a rear side in the traveling direction. The at least two cooling fans are located on the fan coupling surface. The cooling fans have central axes that are separated from each other by a predetermined distance in a vertical direction. The shield rib is located on the fan coupling surface between the adjacent cooling fans. The shield rib extends from an upper side toward a lower side of the fan coupling surface, projects toward the at least one of the radiator and the condenser, and includes an upper end portion and a lower end portion. The at least one of the upper end portion and the lower end portion of the shield rib includes a cut-out portion that allows air to flow between the adjacent cooling fans.

EMBODIMENTS OF THE INVENTION

Figure 1:
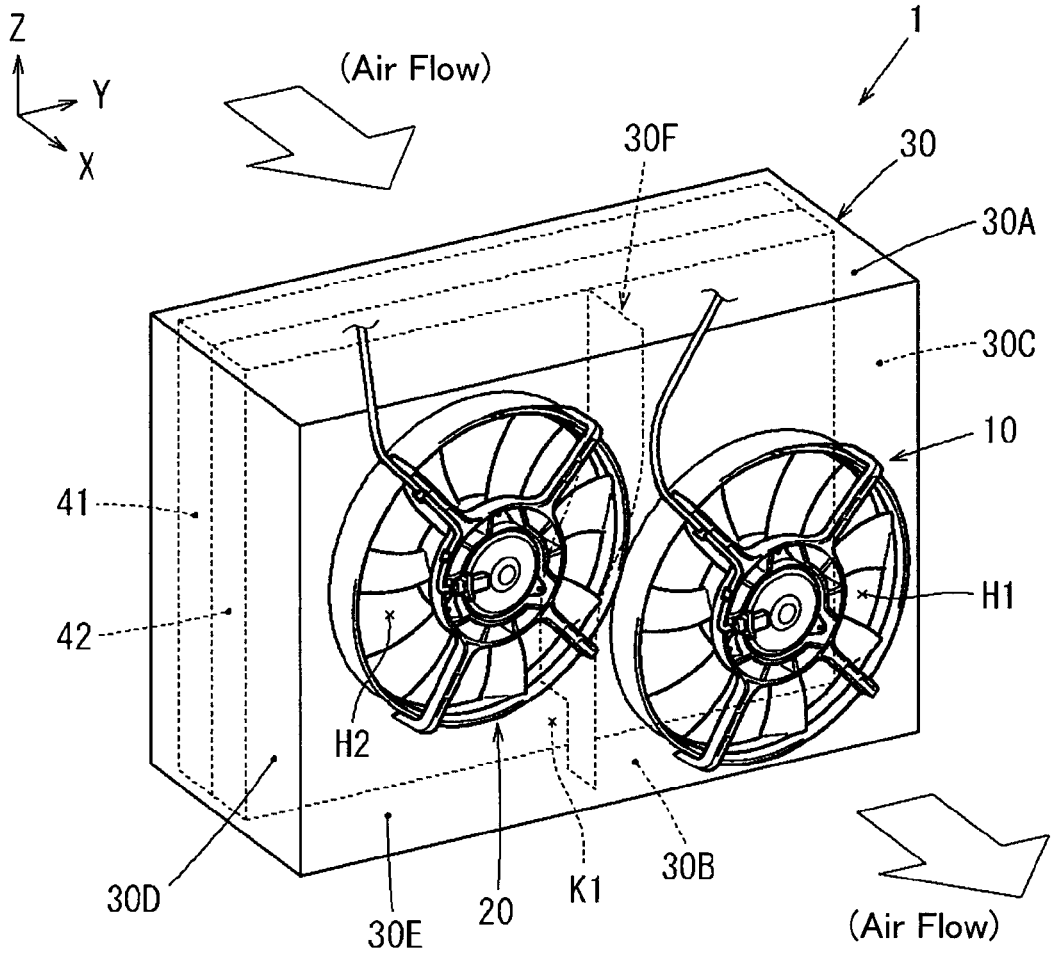
FIG. 1 is a perspective view showing a first embodiment of a vehicle cooling fan device.

Embodiments of the present invention will now be described with reference to the drawings. In the drawings, the X direction, the Y direction, and the Z direction extend perpendicular to each other, the X direction and the Y direction are horizontal directions, and the Z direction extends upward in the vertical direction. The traveling direction of a vehicle in which a vehicle cooling fan device 1 is installed is opposite to the X direction. When the vehicle travels or cooling fans 10 and 20 are driven, a flow of air is generated in the X direction.

First Embodiment

A first embodiment of a vehicle cooling fan device 1 will now be described with reference to FIGS. 1 to 3.

The vehicle cooling fan device 1 includes a box-shaped fan shroud 30, which accommodates at least one of a condenser 41 and a radiator 42, and cooling fans 10 and 20, which are arranged at the rear side of the fan shroud 30 in the traveling direction of the vehicle. The described present embodiment is an example in which the condenser 41 and the radiator 42 are both accommodated in the fan shroud 30 and the condenser 41 is located at the front side of the radiator 42 in the vehicle traveling direction. However, any one of the condenser 41 and the radiator 42 may be arranged at the front side in the vehicle traveling direction.

The box-shaped fan shroud 30 includes a top panel 30A, a bottom panel 30B, a right panel 30C, a left panel 30D, and a rear panel 30E (serving as a fan coupling surface). The front side of the fan shroud 30 in the vehicle traveling direction does not include a panel and is open. The rear panel 30E includes coupling holes H1 and H2 having a diameter corresponding to the diameter of the cooling fans 10 and 20. The cooling fans 10 and 20 are coupled to the coupling holes H1 and H2.

When the vehicle is traveling or the cooling fans 10 and 20 are driven, air flows from the open side to the coupling holes H1 and H2. The air flowing into the fan shroud 30 through the front opening cools the condenser 41 and the radiator 42 accommodated in the fan shroud 30.

The cooling fans 10 and 20 may be rotated and driven by an electric motor or by a belt or the like that transmits rotational driving force from an engine. The described present embodiment is an example in which the cooling fans are rotated and driven by an electric motor.

To maximize the amount of air flowing with the cooling fans 10 and 20, the diameter of the cooling fans 10 and 20 is set to be the largest while allowing the cooling fans 10 and 20 to be coupled to the rear panel 30E. Accordingly, the cooling fans 10 and 20 are difficult to arrange side by side along a straight horizontal line in the rear panel 30E. Thus, as shown in FIG. 2, the cooling fans 10 and 20 are arranged in the lateral direction such that the central axes Z10 and Z20 of the cooling fans 10 and 20 are separated from each other by a predetermined distance (distance D1 in the example of FIG. 2) in the vertical direction.

In addition, the available space in the vehicle is limited. Thus, the cooling fans 10 and 20 are arranged not to overlap each other as viewed in the X direction.

To avoid interference between the cooling fans 10 and 20 when operated, a shield rib 30F is arranged on the rear panel 30E between the adjacent cooling fans 10 and 20. The shield rib 30F extends from the upper side toward the lower side and projects toward the condenser 41 and the radiator 42.

The shield rib 30F, which extends from the upper end to the lower end in the fan shroud 30, partitions the effective range of the flow of air generated by the cooling fan 10 from the effective range of the flow of air generated by the cooling fan 20.

The characteristics of the vehicle cooling fan device 1 will now be described with reference to the rear view of the vehicle cooling fan device 1 shown in FIG. 2 and the cross-sectional view shown in FIG. 3 (cross-sectional view taken along line 3-3 in FIG. 2).

The vehicle cooling fan device 1 is arranged in the limited space of the vehicle (engine compartment) and surrounded by various devices and components.

When installed in the engine compartment, the vehicle cooling fan device 1 is generally placed in front of the engine. The upper side of the vehicle cooling fan device 1 is covered by the hood, and the lower side faces the road. As shown in FIG. 3, a bumper 50 covers the front side of the vehicle cooling fan device 1. A lower portion of the bumper 50 includes an air intake opening 51 for the vehicle cooling fan device 1.

Thus, air discharge regions, which are the regions inside the coupling holes H1 and H2 where the cooling fans 10 and 20 are coupled, include regions where air flows at different velocities. When the air intake opening 51 is formed in the lower portion of the bumper 50, a high flow velocity region A1 indicated in FIG. 2 is defined near the lower portion where air flows smoothly. When the cooling fans 10 and 20 are driven, air tends to flow at a higher velocity in the high flow velocity region A1 than in other regions.

Figure 2:
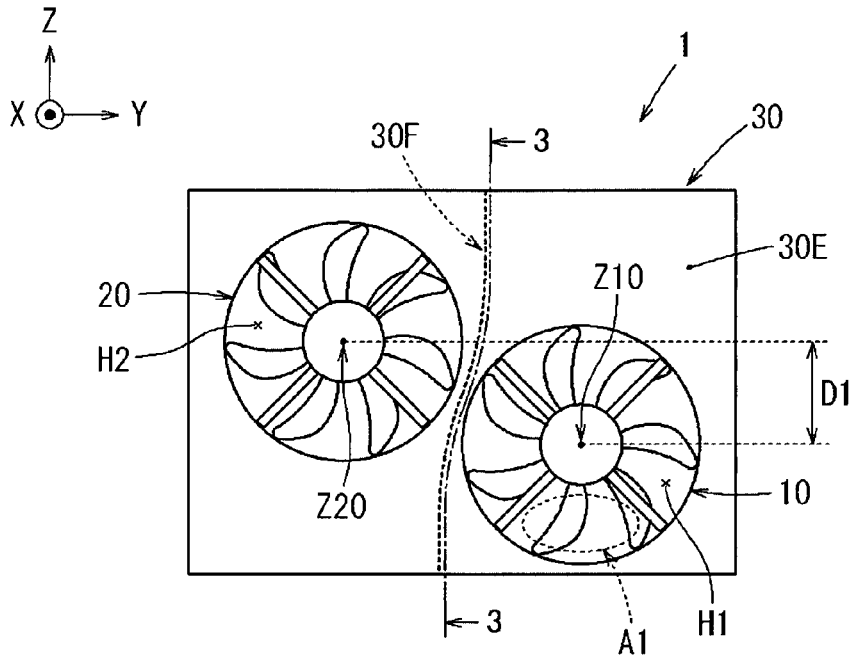
FIG. 2 is a schematic rear view showing the first embodiment of the vehicle cooling fan device.

The high flow velocity region A1 is a lower region in the lower one of the cooling fans (the cooling fan 10 in the example of FIG. 2). In the high flow velocity region A1, the air flowing at a high velocity through the radiator 42, the condenser 41, fan blades, and the like tends to produce noise.

The flow velocity may be measured at different locations in the regions of the cooling fans 10 and 20 (the air discharge regions in the coupling holes H1 and H2) by, for example, arranging a flow rate sensor that has a smaller diameter than the cooling fans near each location in the regions of the cooling fans. This allows for measurement of the flow velocity at the desired portion (by converting the flow rate into a flow velocity).

It is extremely difficult to determine which one of the radiator 42, the condenser 41, fan blades, and the like is the source of noise, and the source may differ depending on the situation. Accordingly, it would be extremely difficult to reduce noise just by changing the shape of the noise source or the like. However, even if the source of noise cannot be located, as long as the cause of noise is the presence of a region where air flows at a higher velocity, the noise can be reduced by eliminating the region where air flows at a higher velocity.

To improve the design of the vehicle or to reduce air friction, there is a tendency for the radiator grille to be reduced in size or omitted and the air intake opening at the front side of the vehicle to be set in the lower portion of vehicle, particularly, the bumper. Thus, a large amount of air flows into the lower portion of the vehicle cooling fan device while the vehicle is traveling, and the flow velocity tends to be high in the lower portion.

Figure 3:
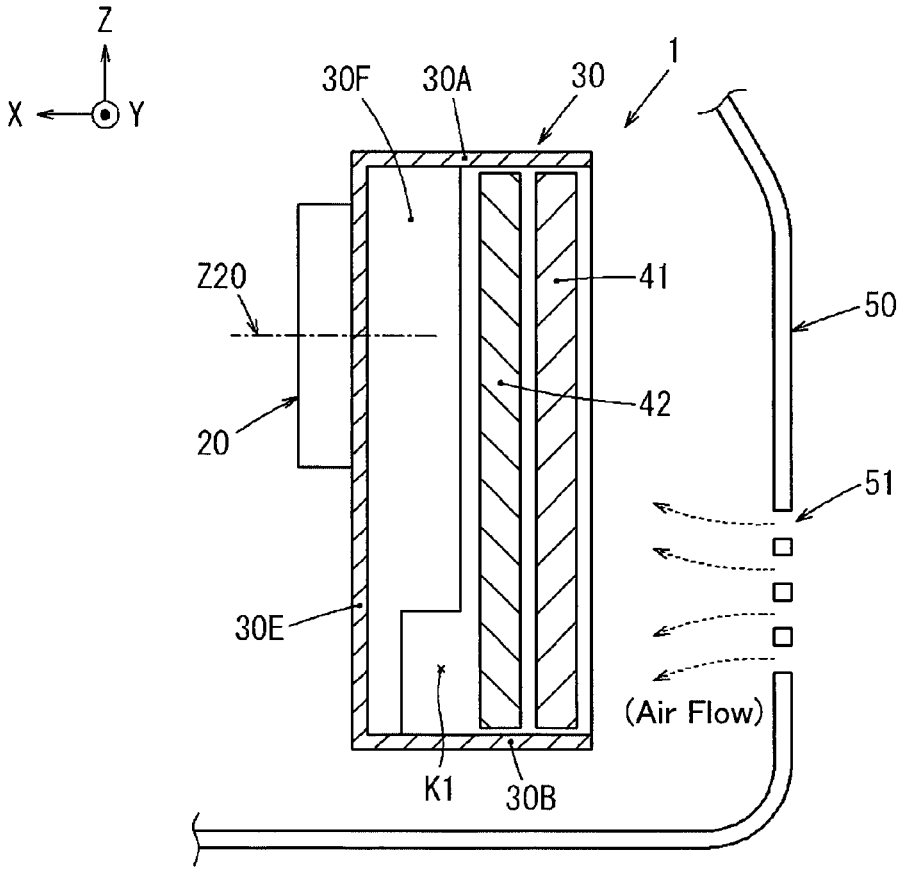
FIG. 3 is a cross-sectional view taken along line 3-3 in FIG. 2.

Thus, as shown in FIG. 3, the lower end portion of the shield rib 30F, which partitions the effective ranges of the cooling fans, includes a cut-out portion K1. The lower end portion of the shield rib 30F refers to the lower end of the shield rib 30F and the vicinity of the lower end.

Due to the cut-out portion K1, when the cooling fan 10 is driven, air flows from the side of the cooling fan 20 through the cut-out portion K1 and into the high flow velocity region A1. Thus, more air flows into the high flow velocity region A1 than when the cut-out portion K1 does not exist. This allows the flow velocity of air to be further decreased in the high flow velocity region A1.

The region where air flows at a high velocity is thus eliminated, and the velocity of the flowing air becomes uniform. This reduces noise when the cooling fans 10 and 20 are driven. Since the velocity of the air flow is decreased, noise is effectively reduced regardless of whether the noise source is the cooling fans 10 and 20, the radiator 42, or the condenser 41. An extremely simple structure, in which a portion of the shield rib 30F in the fan shroud 30 defines the cut-out portion K1, reduces noise without lowering the cooling performance.

Second Embodiment

A vehicle cooling fan device 1A according to a second embodiment will now be described with reference to FIGS. 4 and 5.

In addition to the high flow velocity region A1 in the lower portion of the cooling fan 10 of the first embodiment, the vehicle cooling fan device 1A includes a high flow velocity region A2 where air flows at a high velocity in the upper portion of the cooling fan 20. Depending on where the vehicle cooling fan device 1A is installed or the driving condition of the vehicle, the velocity of air may increase in the high flow velocity region A1 and the high flow velocity region A2.

Figure 5:
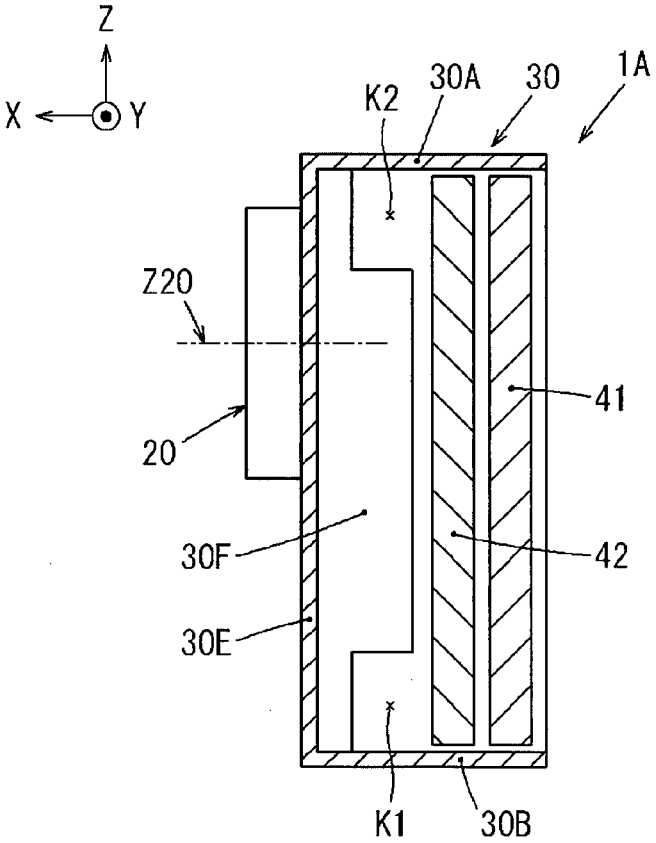
FIG. 5 is a cross-sectional view taken along line 5-5 in FIG. 4.

In this case, as shown in FIG. 5, in addition to the cut-out portion K1 in the lower end portion of the shield rib 30F, the upper end portion (region that includes the upper end and its vicinity) of the shield rib 30F includes a cut-out portion K2.

When the cooling fans 10 and 20 are driven, air flows from the side of the cooling fan 20 into the high flow velocity region A1 through the cut-out portion K1, and air flows from the side of the cooling fan 10 into the high flow velocity region A2 through the cut-out portion K2. This decreases the flow velocity of air in the high flow velocity regions A1 and A2.

As a result, the regions where air flows at a high speed are eliminated, and the velocity of the flowing air becomes uniform. This reduces noise when the cooling fans 10 and 20 are driven.

Figure 4:
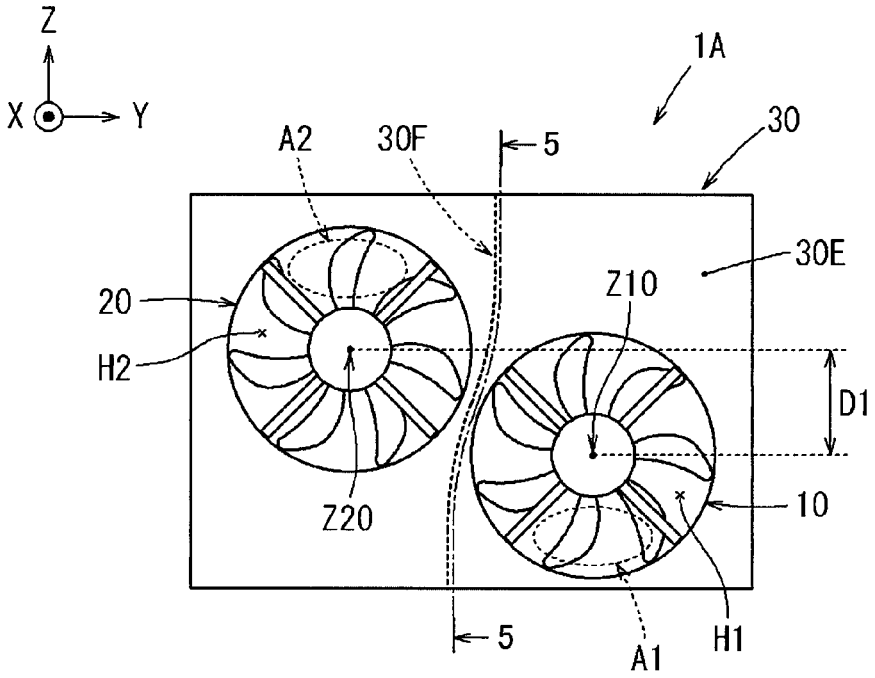
FIG. 4 is a schematic rear view showing a second embodiment of a vehicle cooling fan device.

In the embodiments described above, air flows at a high velocity in the high flow velocity region A1 defined in the lower portion of the lower cooling fan 10 in one embodiment (FIG. 2), and air flows at a high velocity in both of the high flow velocity region A1 and the high flow velocity region A2, which is defined in the upper portion of the upper cooling fan 20, in the other embodiment (FIG. 4). However, if air flows at a high velocity in only the high flow velocity region A2, only the cut-out portion K2 needs to be included in the upper end portion of the shield rib 30F. That is, a cut-out portion need only be included in at least either one of the upper end portion and the lower end portion of the shield rib 30F.

Since the shield rib 30F is arranged to avoid interference between the adjacent cooling fans 10 and 20, the presence of the cut-out portions K1 and K2 may not be preferred. However, as shown in FIGS. 4 and 5, the cut-out portion K1, which reduces the flow velocity in the high flow velocity region A1 of the cooling fan 10, is located in the lower end portion of the shield rib 30F. The cooling fan 20, which may cause interference, is located at the upper side. Thus, the cut-out portion K1 is separated from the cooling fan 20, and interference is restricted. In the same manner, the cut-out portion K2, which reduces the flow velocity in the high flow velocity region A2 of the cooling fan 20, is located in the upper end portion of the shield rib 30F, and the cooling fan 10, which may cause interference, is located at the lower side. Thus, the cut-out portion K2 is separated from the cooling fan 10, and interference is restricted.

The sizes of the cut-out portions K1 and K2 are set to be suitable for reducing noise when the cooling fans 10 and 20 are driven and to avoid interference between the cooling fans 10 and 20.

As described above, an extremely simple structure, in which a cut-out portion is included in at least one of the upper end portion and the lower end portion of the shield rib 30F, decreases the flow velocity of air near the cut-out portion and reduces noise when the cooling fans 10 and 20 are driven. The vehicle cooling fan devices described in the above embodiments have an extremely simple structure in which the shield rib 30F in the fan shroud 30 includes a cut-out portion. Thus, the vehicle cooling fan devices do not reduce the cooling performance, do not require additional space, and may be installed in the limited space of a vehicle like in the prior art.

The vehicle cooling fan device according to the present invention is not limited to the configuration, structure, shape, and the like described in the above embodiments. Various modifications, additions, and omissions are possible without departing from the scope of the invention.

For example, in the description of the above embodiments, the radiator 42 or the condenser 41 is arranged in the fan shroud 30. However, any structure may be employed as long as the fan shroud 30 is able to guide the flow of air to the radiator 42 or the condenser 41. Specifically, the present invention may be embodied in a structure in which the fan shroud 30 does not accommodate the radiator 42, and the front edge of the fan shroud 30 is located near the upper, lower, left, or right side of the outer frame of the radiator 42.

In the description of the present embodiments, the fan shroud 30 is box-shaped and has the form of a rectangular parallelepiped. However, the fan shroud 30 does not have to be a rectangular parallelepiped as long as it is box-shaped.

In the description of the present embodiments, there are two cooling fans 10 and 20. However, the number of the cooling fans may be any number as long as it is two or greater.

The cooling fans 10 and 20 are not limited to electric fans and may be configured to be driven by a belt or the like through which rotational power is transmitted from the engine.

The invention claimed is:

1. A vehicle cooling fan device comprising:

a fan shroud that is box-shaped and accommodates at least one of a radiator and a condenser, wherein the fan shroud includes an opening located at a front side in a traveling direction of a vehicle and a fan coupling surface located at a rear side in the traveling direction;

at least two cooling fans located on the fan coupling surface, wherein the cooling fans have central axes that are separated from each other by a predetermined distance in a vertical direction; and a shield rib that is located on the fan coupling surface between the adjacent cooling fans, wherein the shield rib extends from an upper side to a lower side of the fan coupling surface and contacts both the upper side and the lower side, projects toward the at least one of the radiator and the condenser, and includes an upper end portion and a lower end portion, wherein at least one of the upper end portion and the lower end portion of the shield rib includes a cut-out portion that allows air to flow between the adjacent cooling fans.

2. The vehicle cooling fan device according to claim 1, wherein the lower end portion of the shield rib includes the cut-out portion.

3. The vehicle cooling fan device according to claim 1, wherein the cut-out portion is a section of the shield rib in which a length of the wall in the traveling direction of the vehicle is shorter than an overall length of the shield rib in the traveling direction of the vehicle.

4. A vehicle cooling fan device comprising:

a fan shroud that includes an opening located at a front side in a traveling direction of a vehicle, wherein the fan shroud guides a flow of air to at least one of a radiator and a condenser;

cooling fans accommodated in the fan shroud, wherein at least two adjacent ones of the cooling fans are arranged in a lateral direction and include central axes that are separated from each other by a predetermined distance in a vertical direction; and a shield rib located in the fan shroud between the two adjacent cooling fans, wherein the shield rib extends from an upper side of the fan shroud to a lower side of the fan shroud and contacts both the upper side and the lower side, partitions the cooling fans from each other, and includes an upper end portion and a lower end portion, wherein at least one of the upper end portion and the lower end portion of the shield rib includes a cut-out portion that allows air to flow between the adjacent cooling fans.

5. The vehicle cooling fan device according to claim 4, wherein the lower end portion of the shield rib includes the cut-out portion.

* * * * *